United States Patent [19]

Helgesson

[11] 3,965,434

[45] June 22, 1976

[54] AUTOMATIC FREQUENCY CONTROL SYSTEM FOR DRIVING A LINEAR ACCELERATOR

[75] Inventor: Alan L. Helgesson, Los Altos Hills, Calif.

[73] Assignee: SHM Nuclear Corporation, Sunnyvale, Calif.

[22] Filed: Dec. 1, 1972

[21] Appl. No.: 311,292

[52] U.S. Cl. ..... 328/233; 315/5.41; 315/39.51; 315/63; 250/492 B

[51] Int. Cl.[2] ..... H05H 9/00

[58] Field of Search ..... 315/5.13, 39.51, 61, 315/63, 5.42, 5.41; 328/233; 313/93; 331/5, 6; 250/492 A, 492 B, 396, 397, 300

[56] References Cited

UNITED STATES PATENTS 3,221,165 11/1965 Goodale et al. ..... 313/93

3,714,592 1/1973 Jory ..... 328/233

3,719,827 3/1973 Dennis ..... 313/61 S

*Primary Examiner*—Alfred E. Smith

*Assistant Examiner*—Richard A. Rosenberger

*Attorney, Agent, or Firm*—Limbach, Limbach & Sutton

[57] ABSTRACT

An automatic frequency control system is described for maintaining the drive frequency applied to a linear accelerator to produce maximum particle output from the accelerator. The particle output amplitude is measured and the frequency of the radio frequency source powering the linear accelerator is adjusted to maximize particle output amplitude.

12 Claims, 4 Drawing Figures

AUTOMATIC FREQUENCY CONTROL SYSTEM FOR DRIVING A LINEAR ACCELERATOR

BACKGROUND OF INVENTION

Particle accelerators such as linear accelerators are used today in a number of different applications such as radio therapy, radiography and sterilization. In most of these applications the particle accelerator is used to generate X rays that are applied to the object.

It is very important that a constant dose rate output from the accelerator be achieved over both the short period of time, such as during a specific therapy treatment, as well as the long period of time such as day to day during successive treatments.

One of the biggest sources of possible variation in the output from an accelerator is the change in particle output amplitude resulting from a mismatch between the operating frequency of the accelerator and the driving frequency signal applied thereto. This mismatch can result from dimensional changes in the accelerator structure due to changes in the temperature of the structure or differential expansion in different parts of the accelerator structure thereby resulting in a change in its operational frequency.

In the past, efforts to maintain desired relationship between the driving frequency source and the accelerator have been to use a stabilization device such as a stabilizing frequency cavity which is physically attached and maintained in the environment of the accelerator and stabilizes the frequency of the source to the operational frequency of the accelerator. Changes in the dimensions of the accelerator causing a change in its operational frequency would usually also be accompanied by a change in the stabilization cavity so that the stabilization cavity would stabilize the driving signal source at the desired frequency for operation of the accelerator. However, it has never been possible to perfectly match the stabilization cavity to the accelerator structure and thereby keep the driver source tuned to the best operational frequency for the accelerator.

SUMMARY OF THE INVENTION

This invention relates to an automatic frequency control for maintaining the frequency of the accelerator driver source always tuned to the operational frequency of the accelerator.

In accordance with this invention method and apparatus are provided whereby the particle output amplitude from the accelerator is measured and the frequency of the driver source is maintained at a desired level to maximize the particle output amplitude.

The particle output amplitude is measured by a signal derived from an ionization chamber wherein current pulses are sampled to obtain an output signal representative of modulated particle (X-ray) pulses. This signal is amplified and applied through the automatic frequency control aspect of the system to a stepping pulse generator wherein a signal is added to minimize power modulation effects of the accelerator RF source and synchronously demodulated to produce a frequency error voltage and stepping pulses having rates which are proportional to this error voltage. The stepping pulses are directed to the drive of a stepping motor to step the tuner of the driver source to the point where particle amplitude is maximized.

In accordance with another aspect of this invention, the principle components of the system can also be used in a manual frequency mode wherein the desired frequency for the driver source is set and the stepping motor driven with stepping pulses until the difference between the desired setting and the frequency setting measured on the source is reduced to zero.

These and other features and advantages will become more apparent upon a perusal of the following specification taken in conjunction with the accompanying drawings wherein similar characters of reference refer to similar structures in each of the several views.

DETAILED DESCRIPTION OF A PREFERRED EMBODIMENT OF THE INVENTION

While it will be appreciated that the present invention has application to automatic frequency control in other applications such as with other particle generating systems, it is ideally suited to automatic frequency control of a linear accelerator system and thus will be described with reference thereto.

Figure 1:
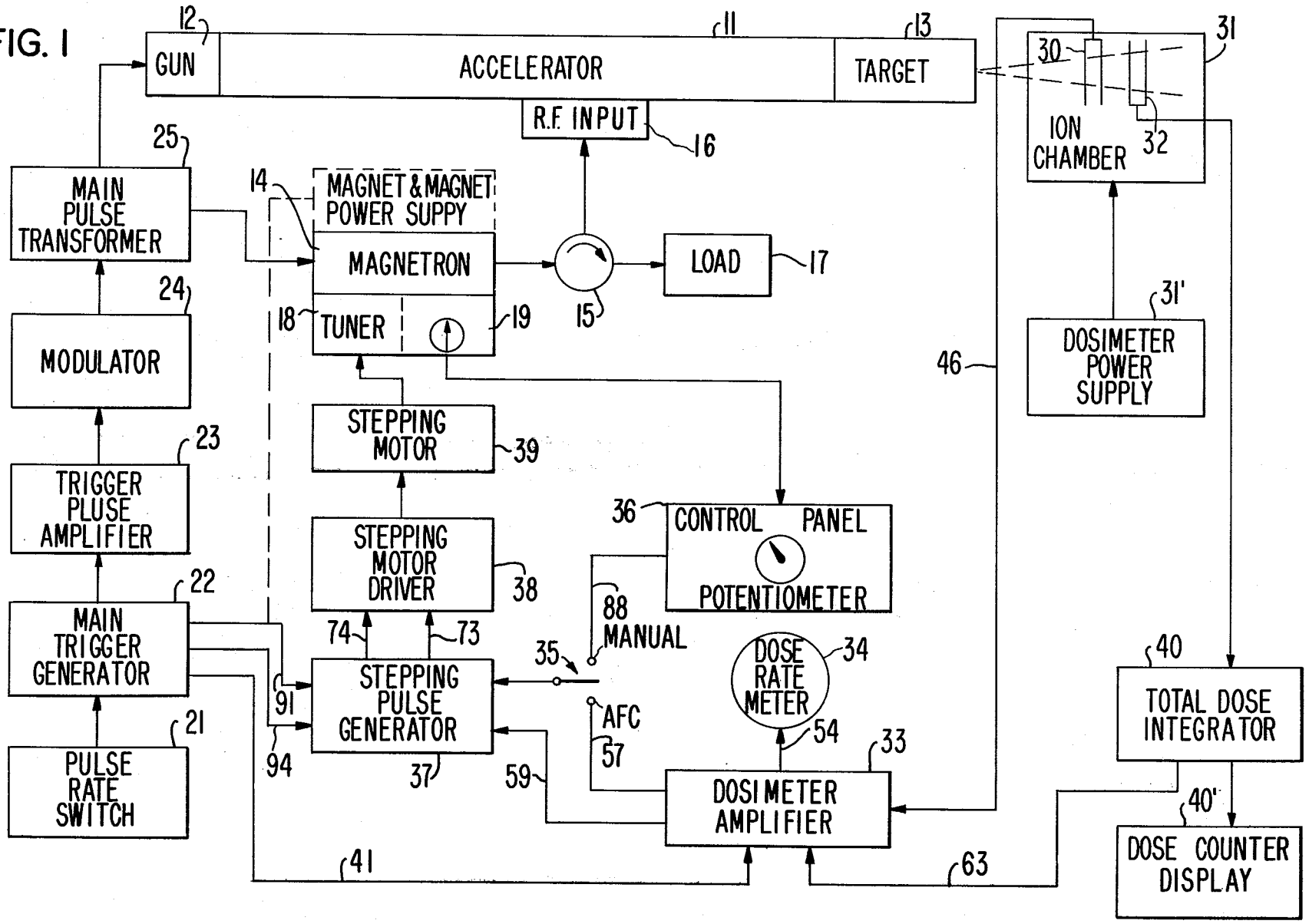
FIG. 1 is a schematic block diagram of an accelerator control system in accordance with the present invention.

Referring now to the drawings with particular reference to FIG. 1, a linear accelerator 11 is schematically illustrated provided with an electron gun assembly 12 at one end for generating and directing a stream of electrons longitudinally of the accelerator and a target 13 such as of gold positioned at the opposite end for generation of X-rays upon bombardment by the accelerated stream of electrons. This stream of electrons is accelerated by energy exchange with a radio frequency wave which is introduced at an appropriate cavity of the accelerator 11 which takes the form of a coupled cavity structure.

The radio frequency energy is directed to the accelerator 11 from a source such as a magnetron or a klystron tube. In the present illustrative embodiment a magnetron 14 is provided with its output directed through a circulator 15 to the RF input window 16 of the accelerator 11. An RF load 17 is also connected to the circulator 15 to absorb any reflected energy.

The magnetron 14 is provided with a tuner assembly 18 of any well-known type and an associated potentiometer 19 calibrated with the output frequency of the magnetron.

For establishing the pulsed electron beam in the accelerator and automatic frequency control of the system a pulse rate switch 21 is provided for selecting the desired pulse rates such as 120, 180, 240, 300 and 360 pulses per second (pps) as established in a main trigger generator 22. Trigger pulses established in this generator 22 are amplified in a trigger pulse amplifier 23 and directed to a modulator 24 for modulation of the magnetron 14 and the accelerator gun 12 through a main pulse transformer 25.

The X-ray intensity output of the accelerator is monitored in an ion chamber 31 having pairs of plates 30 and 32 and associated plates (not shown) connected to a dosimeter power supply 31'. The X-rays passing through the dose chamber produce an ionization of the air in the chamber and cause a charge to be collected on plates therein. A pulse current from one of the two plates 30 of the ionization chamber 31 is directed to a dosimeter amplifier 33 which filters and amplifies its current to display a dose rate on a dose rate meter 34 located on the front of the control console for the accelerator. The dosimeter amplifier 33 also samples the pulse current to obtain an output signal representative of the modulated X-ray pulses for use in the automatic frequency control (AFC) system.

A switch 35 is provided to switch between AFC operation and a manual operation system wherein a desired operational frequency is manually selected on a potentiometer 36 on the control panel for the accelerator.

Control of the magnetron frequency through the AFC or manual selection process is accomplished by connection of the output from switch 35 through a stepping pulse generator 37 which is connected to a stepping motor driver assembly 38 for drive of a stepping motor 39 connected to the magnetron tuner 18.

In the manual mode of operation with switch 35 connecting potentiometer 36 to the stepping pulse generator 37, an amplifier in the stepping pulse generator 37 is provided with an input which is the difference between the frequency setting of the magnetron potentiometer 19 and the desired operational frequency on the control panel potentiometer 36. Stepping pulses are generated and directed to the stepping motor driver 38 and stepping motor 39 for movement of the magnetron tuner 18 until the difference of this input is reduced to zero at which point the magnetron is tuned to the desired frequency manually set on the control potentiometer 36.

In the AFC mode, the stepping pulse generator 37 obtains a 5 Hz square wave signal from the main trigger pulse generator 22 to produce a sawtooth frequency modulation of the magnetron. The generator 37 also receives a return signal via the ion chamber 31 and dosimeter amplifier 33 representing the modulated X-ray pulse amplitude, adds a signal to minimize the power modulation effects of the magnetron, and synchronously demodulates the net signal to produce a frequency error input voltage to a dual output amplifier for driving the tuner stepping motor 39 through the stepping motor driver 38. The resulting net signal in the stepping pulse generator 37 before demodulation has amplitude and polarity which are determined by the frequency modulation of the magnetron and the offset between the magnetron frequency and the resonant frequency of the accelerator guide, at which maximum X-rays are produced.

A total dose integrator 40 receives current from another plate 32 of the ionization chamber 31 and produces an output pulse each time that a charge equivalent to 1 rad of total dose has been accumulated. The dose integrator 40 is interlocked so that the 1 rad output pulses can be obtained only when X-rays are turned on. These output pulses go to the counter input of a dose decade counter display 40' and to the dosimeter amplifier 33 as one of the inputs to the dosimeter alarm portion of the dosimeter amplifier 33.

Figure 2:
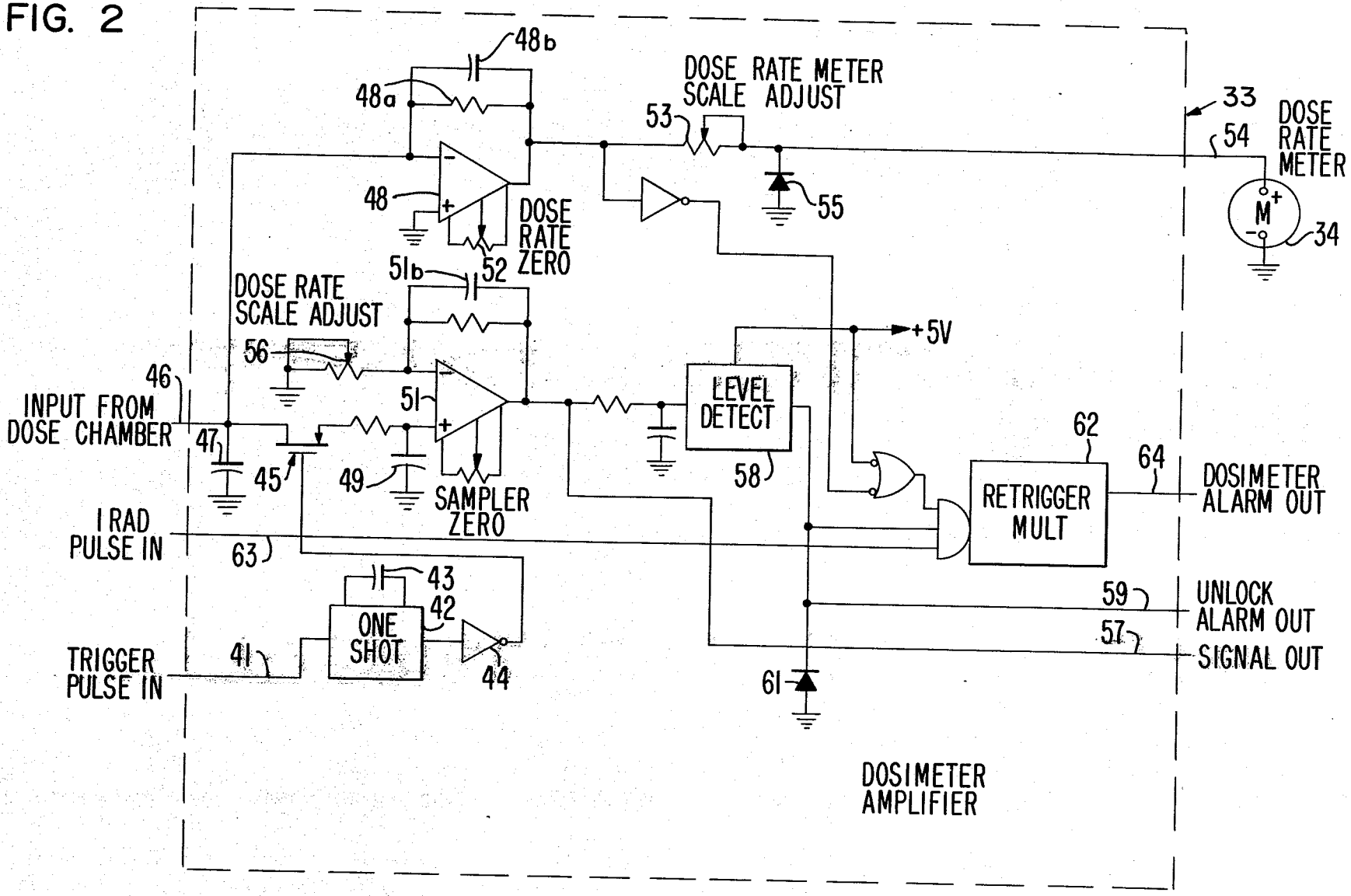
FIG. 2 is a block diagram of a dosimeter amplifier utilizable with this invention.

Referring now to FIG. 2 there is shown a schematic block circuit block diagram of the dosimeter amplifier 33. Besides sampling the ionization chamber plate current to display dose rate and obtain a signal representative of the modulated X-ray pulses for use in the AFC system, an unlock alarm signal is generated if the X-ray output is too low, and this unlock alarm signal causes the AFC system to scan, looking for the right frequency. Additionally, a dosimeter alarm circuit compares the output of the dose rate circuit, the sampling circuit and the rate of rad pulses from the integrator 40. If any of these latter three signals are below pre-set thresholds, due either to failures in the circuits, the cables, the chamber 31 or supply 31', a dosimeter alarm is initiated which turns the X-rays off.

With specific reference to FIG. 2, whether X-rays are on or not, negative trigger pulses to be used for generating sampling pulses are present at input 41, which are obtained from the main trigger pulse generator 22. The frequency, from 120 to 360 pps, of these pulses is set by the pulse rate switch 21 on the control panel. These pulses trigger a one-shot multivibrator 42 which produces positive output pulses such as of 20 ns width in this one illustrative embodiment as determined by a timing capacitor 43, and drives an inverting amplifier 44 to produce a negative going pulse of 15 volt amplitude. This pulse drives a sample and hold FET circuit 45 which receives, when X-rays are on, pulses of negative current flow through a coaxial line 46 from plate 32 in the ionization chamber in the X-ray beam. These current pulses produce negative voltage pulses on the input capacitor 47 which decay to ground potential due to the loading of an inverting operational amplifier circuit 48 input. The peak negative voltage on the input capacitor 47 is sampled and transferred to a holding capacitor 49 connected to the input of a non-inverting operational amplifier 51.

Since the holding capacitor 49 is a small percentage of the input capacitor 47, very little current flows, and after the first pulse the current through the FET switch 45 will depend only on the difference between the pulse being sampled and the previous pulse. Both operational amplifiers 48 and 51 are FET input amplifiers having extremely low bias current. Therefore, there is essentially no charge from the ionization chamber lost in the operational amplifier inputs, consequently all ionization chamber charge must flow through the input resistor and feedback resistor **48*a* of the inverting operational amplifier 48 where, with the aid of the filtering effect of a feedback capacitor 48*b***, the averaged output voltage is a faithful reproduction of the average dose rate.

A zero adjustment for this dose rate output voltage is provided by a potentiometer 52 in the operational amplifier circuit 48, and a potentiometer 53 leading to an output 54 sets the average current to the dose rate meter 34 on the control console panel. A shunt diode 55 serves as a reverse voltage protection for the dose rate meter 34 during initial calibration and testing.

The sampled voltage held on the holding capacitor 49 is amplified by the non-inverting operational amplifier 51 and an operational amplifier input potentiometer 56 furnishes a gain adjustment. A small amount of filtering is provided by a feedback capacitor **51*b* so that the output is a faithful reproduction on a pulse-to-pulse basis of the charge collected by the ionization chamber and exists at the amplifier 51 output as a signal of approximately −9 volts average level. This signal leaves the dosimeter amplifier circuit 33 at output 57 for purposes of AFC tuning where the modulation riding on this signal is AC coupled to a synchronous detector in the stepping pulse generator 37.**

For providing low X-ray level and off frequency alarms the average level of the signal at the operational amplifier 51 output is filtered and is normally negative enough to keep the output of a level detect circuit 58 high. This puts the output voltage at output 59 up to +5 volts representing no unlock alarm. When the X-ray pulse amplitude is reduced to approximately 70 percent of its normal level, the non-inverting operational amplitude 49 output rises to the point where it causes the level detect circuit 58 output to be clamped near ground potential by a diode 61 at its output. The unlock alarm voltage now near ground potential goes to the stepping pulse generator circuit 37 where it initiates a frequency scan when the switch 35 is in the AFC mode. When in the manual mode, this voltage has no effect on the frequency setting.

A retriggerable multivibrator 62 is provided, such as an integrated circuit, having the property that, if it is retriggered by an input pulse before its cycle recovery from a previous one, it begins a new pulse. At the lowest pulse rate settting of 120 pps and for normal X-ray output, one rad pulses from the total dose integrator which enter at input 63, continuously cause retriggering at timed intervals which are approximately one-third of the 1.5 second pulse width as set by the pulse width setting network. This causes an output 64 to be continuously low representing no dosimeter alarm to the fault logic of the system. If the total dose integrator 40 fails to function, or if it delivers pulses at less than one-third its minimum rate, the dosimeter alarm output 64 will rise at the end of a 1.5 second interval and X-rays will be turned off. Normally the dosimeter rate input voltage to the multivibrator 62 logic is zero and the amplitude discrimination input is high. If either of these two voltages changes state, due either to the failure of the dose rate amplifier 48 circuit or the sampling amplifier 52 circuit, these new voltage levels into the retriggering multivibrator 62 input logic will inhibit the retriggering by the 1 rad pulses. A dosimeter alarm then results at output 64.

Figure 3:
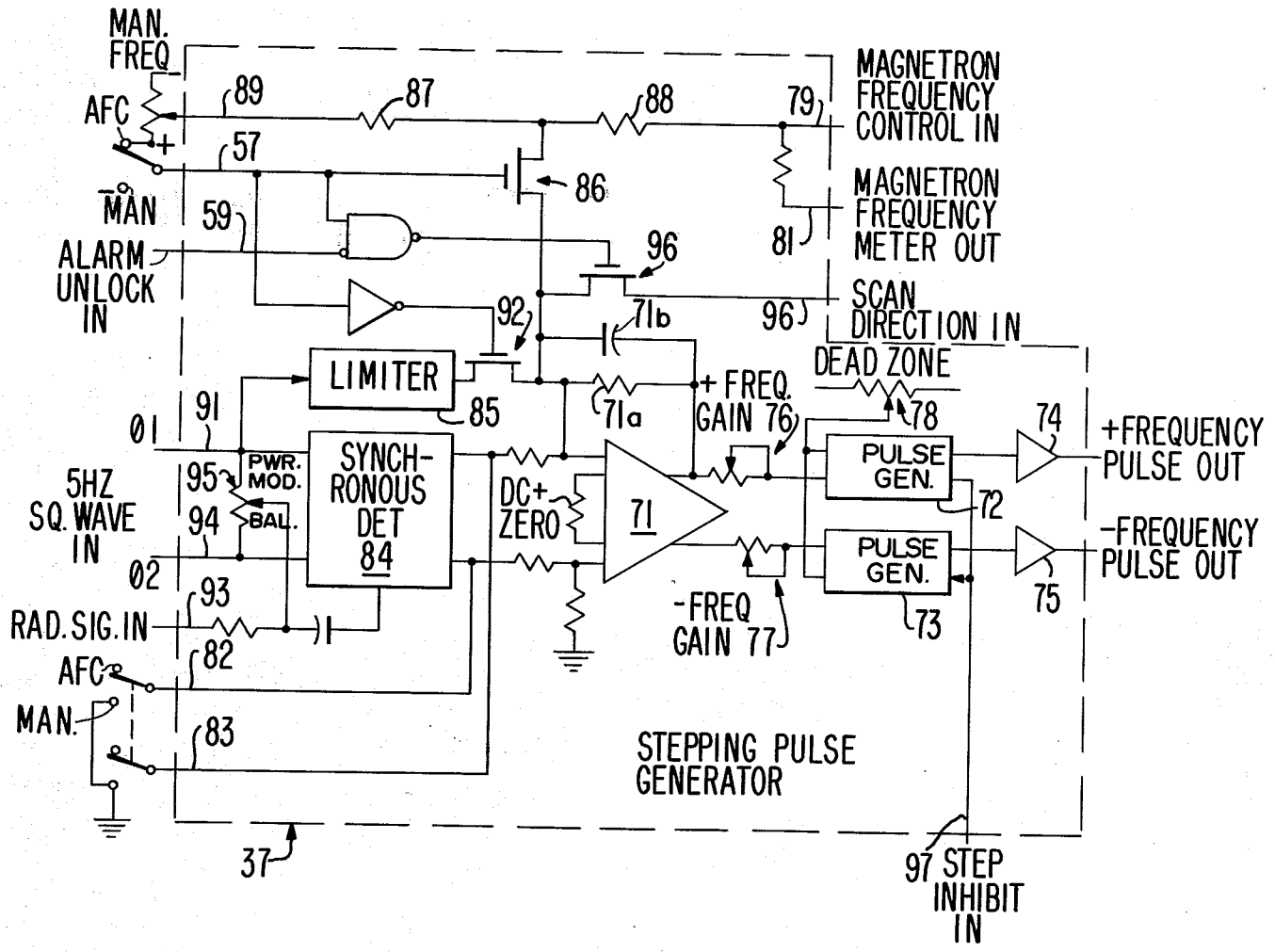
FIG. 3 is a block diagram of a stepping pulse generator utilizable with the present invention.

As shown in FIG. 3 the stepping pulse generator circuit 37 contains a dual output operational amplifier 71 which drives two separate stepping pulse generators 72 and 73. These generators 73 and 72 produce decrease and increase frequency pulses for the stepping motor driver assembly 38 which drives the stepping motor 39 to control the magnetron tuner 18 as described in greater detail below with reference to FIG. 4. In the manual position of control 35 the amplifier 71 obtains an input which is the difference between the frequency setting, as measured on the magnetron tuner potentiometer 19, and the desired frequency as set by the manual frequency potentiometer 36 on the control panel. Stepping pulses are generated until this difference is reduced to zero. In the AFC mode, the circuit 37 obtains a 5 Hz square wave signal from the main trigger pulse generator 22 which is used to produce a sawtooth frequency modulation of the magnetron 14. The circuit receives a return signal on input 93 representing the modulated X-ray pulse amplitude from the dosimeter amplifier circuit 33, adds a signal to this to minimize the power modulation effects of the magnetron, and synchronously demodulates the net signal to produce a frequency error input voltage to the dual output amplifier 71. The stepping pulses have rates which are proportional to this error voltage. A separate unlock alarm input 59 will initiate a sawtooth frequency scan in the AFC mode if the X-ray amplitude is below approximately 70 percent of its normal level.

The dual input, dual output integrated circuit operational amplifier 71 has its corresponding inputs and outputs oppositely phased. A DC zero adjustment is provided. Frequency roll off and amplifier gain characteristics are accomplished by the shunt 71*a* and 71*b* network connected as feedback around the amplifier 71. The output has a dynamic range of approximately −8 to +8 volts. When the plus frequency output signal is positive and increasing, it increases the charge rate of a unijunction transistor pulse circuit within the upper pulse generator 72 as shown in the block diagram causing an increase of increase frequency pulses at output 74.

At the same time, the opposite amplifier output is equally negative and cuts the lower pulse generator 73 off which results in an absence of decrease frequency pulses at output 75. The two circuits are similar and operate symmetrically and have plus frequency gain and minus frequency gain potentiometers 76 and 77 in their respective pulse circuit charge paths for factory adjustments. When the two operational amplifier outputs are equal in voltage, this voltage is not necessarily zero, and a dead zone adjustment 78 is therefore necessary to get a smooth cross over between the positive and negative pulse generators. The outputs 74 and 75 are positive going, 5 volt pulses, AC coupled into an external 180 ohm load in the stepping motor drive assembly 38. The two pulse generators 72 and 73 are cross coupled to inhibit the charge rate of each other so that random noise at the output of the operational amplifier 71 will not cause simultaneous unijunction triggering in both pulse generators, which would result in random stepping. Both pulse generators 72 and 73 are inhibited by a −15 volt signal entering at input 97 during the first second after X-rays are turned on. After this one second delay, in which the high voltage is being run up in the modulator 24, the pulse generators are released and frequency tuning can commence either manually or automatically.

As previously stated, the increase and decrease frequency pulses out of this circuit are decoded by the stepping motor driver assembly 38, to drive the stepping motor 39 on the magnetron tuner 18. This motor tunes the magnetron over a frequency range of approximately 1.5 gHz. The potentiometer 19 on this assembly is coupled to the motor to produce an analog indication of the position of the tuner within this range. The voltage from this potentiometer, which increases as the frequency increases, enters at input 79 and is brought out through output 81 to a frequency meter on the control panel.

When the AFC-control switch 35 on the control panel is in the manual position, inputs 82 and 83 are grounded, and a minus voltage input exists on input 57. Inputs from a synchronous detector 84 to the operational amplifier 71 are therefore grounded. A limiter 85 and the scan direction inputs to the amplifier 71 are disconnected by the minus voltage inputs to their respective FET switch circuits. The only input remaining comes from the minus voltage actuated FET switch 86 connecting to the voltage averaging resistors 87 and 88 which exist between the manual frequency adjust potentiometer voltage at input 89 and the magnetron frequency control voltage entering at input 79. Pulses are produced until the averaged voltage between the two inputs is reduced to zero, at which point the magnetron is tuned to the desired frequency as set by the manual frequency adjust potentiometer 36.

In the AFC mode, input 57 is positive which disconnects the manual frequency control circuits and connects the limiter 85 signal to the operational amplifier 71. The synchronous detector 84 also becomes effective by having its outputs disconnected from ground. In the AFC mode the circuit 37 is used both to provide frequency modulation of the magnetron and to tune the magnetron for maximum X-ray output in response to a return signal which the card synchronously demodulates. The 5 Hz square wave modulating signal froom the main trigger pulse generator 22 entering at input 91 is limited and coupled through its FET switch 92 to the operational amplifier 71. The amplifier partially integrates this signal to produce oppositely-phased approximate sawtooth voltages at its two outputs which respectively modulate the pulse rate generators, and consequently frequency modulating the magnetron.

A signal from a sample and hold amplifier of the dosimeter amplifier circuit enters at input 93. This signal represents the pulse-to-pulse variation in X-ray amplitude. A 5 Hz square wave at inputs at 91 and 94 from the main trigger generator and whose amplitudes and polarities are adjustable by a power modulator balance potentiometer 95 is added to this signal to cancel X-ray amplitude modulation produced by power modulation of the magnetron. The resulting AC portion of the signal which is capacitance coupled to the synchronous detector 84, has amplitude and polarity which are determined by the frequency modulation of the magnetron plus the offset between the magnetron frequency and the accelerator guide resonant frequency, at which maximum X-rays are produced. This signal will have zero amplitude if the frequency offset between magnetron and accelerator guide is zero. This signal is detected to produce a DC input to the operational amplifier 71 by the synchronous detector 84 whose gating signals are the oppositely phased 5 Hz square waves entering at inputs 91 and 94. The DC input is amplified by the inverting and non-inverting gain alternately with the net resulting output being additive and representing either an increase or decrease frequency tuning signal. When the demodulated DC voltage is different from zero, stepping pulses are generated which tune the magnetron so as to produce maximum X-ray output, at which point the synchronously detected amplitude variations will be zero.

The unlock alarm signal at input 59 comes from the dosimeter amplifier circuit 33 and is normally +5 volts unless the X-ray amplitude is less than 70 percent of its normal value, in which case this voltage goes to ground potential. The ground state represents an unlock alarm which turns the scan direction FET switch 96 on and permits scan signal inputs to the operational amplifier which are sufficient to drive the amplifier to its positive or negative saturation limits depending from input 96 on the setting of a scan direction switch on the magnetron tuner assembly. This signal is strong enough to override any input signal entering the operation amplifier 71 from the synchronous detector 84. Frequency is then scanned, and at the end of travel, the scan direction switch is toggled so that a scan in the reverse direction is initiated. One period of this sawtooth frequency scan takes approximately two seconds. As the magnetron frequency approaches the frequency at which maximum X-rays are generated, the unlock alarm signal will change state, open circuiting the scan signal path anad stopping the scan. The input signal from the synchronous detector 84 will then take over and the servo will achieve capture in the normal fashion. Should the peak X-ray level be less than 70 percent of normal for some reason, the unlock alarm input will not change state, and X-rays will be turned off within 1.5 seconds by the dosimeter alarm circuit on the dosimeter amplifier circuit 33. Frequency scanning will continue until the time of X-ray turn off, at which point a negative voltage input at input 97 will inhibit the two stepping generators.

Figure 4:
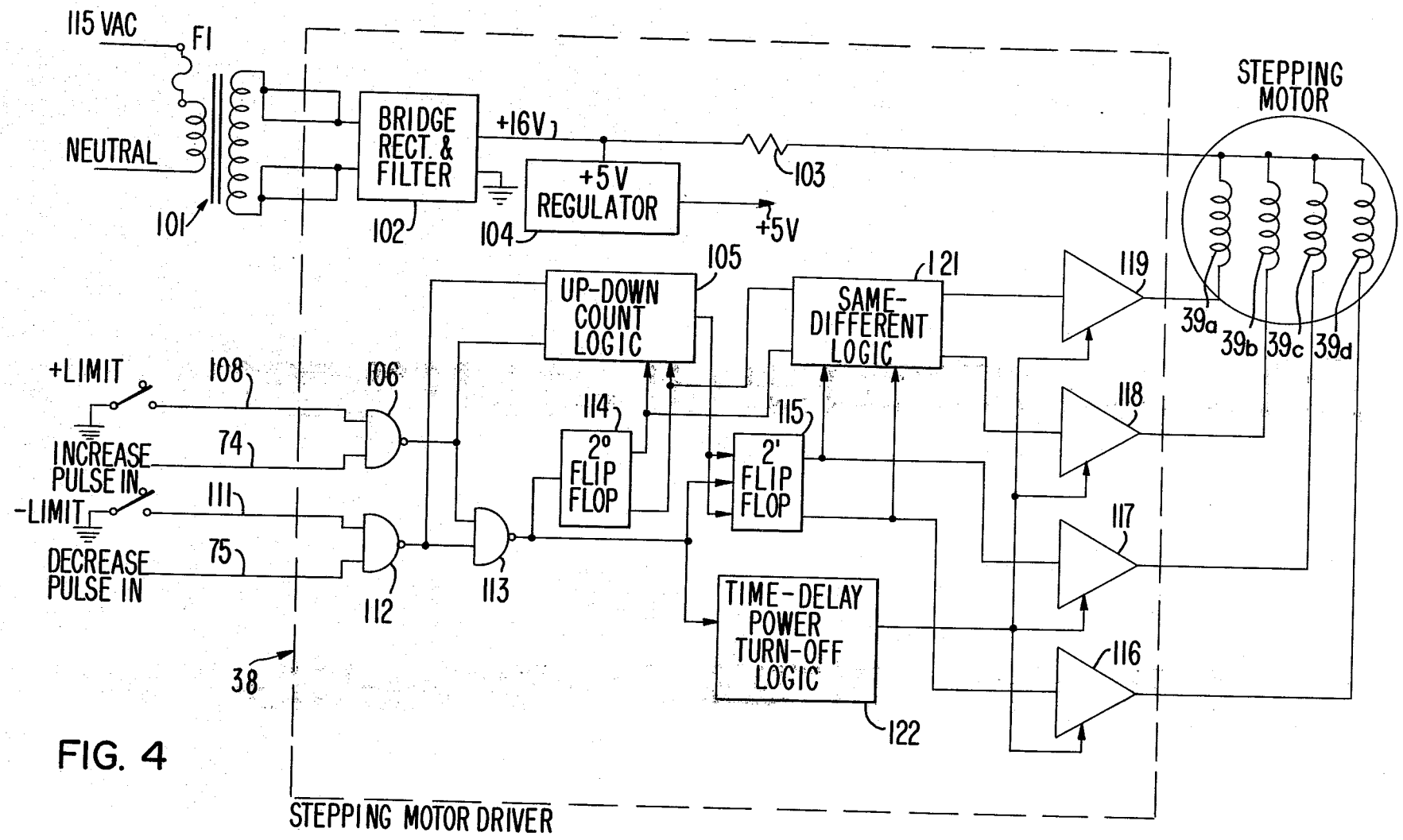
FIG. 4 is a block diagram of a stepping motor driver assembly utilizable with the present invention.

Carrying on from the stepping pulse generator 38 of FIG. 3 to the stepping motor drive of FIG. 4, the stepping motor driver circuit accepts 115 VAC as a power input and generates +16 VDC for powering the stepping motor 39 and +5 VDC for powering the digital driving logic. Increase and decrease pulses enter on coaxial line inputs from the stepping pulse generator 37. These pulses are counted and decoded by the digital logic so that the four windings 39*a–d* on the stepping motor 39 are energized in proper sequence.

The 115 VAC input is transformed in transformer 101 to 12.6 VAC which is full wave rectified and filtered at 102 to produce +16 VDC. A power resistor 103 drops this voltage to +8 VDC when the stepping motor 39 is operated in the normal manner. A regulator 104 for the power supply produces +5 volts for powering the circuits of the driver.

A positive increase pulse enters the card at input 74. This line is normally held down to a voltage near ground potential. The input should be at least 3 volts in amplitude and greater than 30 micro-seconds duration to produce a step. A negative output pulse is produced which sets the up-down count logic 105 to the increase state. The increase pulse is inhibited from passing through a first gate 106 if the increase limit switch 107 is closed. This line at input 108 is normally pulled up to +5 volts, but is grounded when the limit switch is actuated. The closing of the limit switch 107 does not produce any extra steps. A similar channel for decrease input pulses and the decrease limit switch 109 enters the card at inputs 75 and 111 producing negative decrease pulses through gate 112. These pulses set the up-down count logic 105 states to the opposite state. Both increase and decrease pulses produce through gate 113 positive pulse outputs each of which produces a toggling of a $2^0$ flip-flop 114 on the trailing edge of the pulse. A $2^1$ flip-flop 115 is toggled on every other pulse, as controlled by the up-down count logic 105, so that the two flip-flops function as an up-down counter. The outputs from the $2^1$ flip-flop 115 drive the current amplifying channels 116 and 117 with oppositely phased square wave signals having the frequency of one-quarter the input pulse repetition rate. The outputs of the $2^0$ and $2^1$ flip-flops 114 and 115 are decoded by the same-different logic 121 to drive the other two current amplifying channels 118 and 119 with oppositely phased square waves also having the frequency of one-quarter the input pulse repetition rate.

A time-delay power turn-off logic 122 removes power from all four motor windings when no pulses are being received. This circuit senses when the spacing between pulses becomes greater than several seconds and produces an inhibiting input to all four current amplifiers 116–119.

The main trigger pulse generator 22 takes three different phases of 12.6 VAC as inputs, producing pulses at the zero crossings of each to form a set of 6 pulses per line cycle. Different combinations of these six pulses are selected by the pulse rate switch 21 on the control panel for pulse rates of 120, 180, 240, 300 or 360 pulses per second (pps) to trigger the main thyratron in the modulator and to supply pulses to the sample pulse generators on a gun heater controller and to the dosimeter amplifiers circuit 33. These pulses are inhibited when a magnetron single misfire alarm occurs. In addition, these pulses are used to derive a square wave 5 Hz signal for the stepping pulse frequency modulation and demodulation used for AFC mode magnetron tuning.

While the invention has been described with reference to the use of a stepping motor and a stepping motor drive, other means such as a DC motor driven by the frequency error voltage can be utilized.

In other applications magnetrons have been modulated either by voltage modulation of the magnetron or a probe in the output to which a modulating signal is applied for reflective modulation of the magnetron signal. Both of these techniques result in undesirable power modulations. Frequency modulation by modulation of the tuner in accordance with the present invention results in minimum power modulation.

In accordance with another aspect of the present invention, the magnetron can be frequency modulated by modulating the magnetron magnet. This can be accomplished by a modification of the magnetic field of a permanent magnet but is more easily accomplished when an electromagnet is used for the magnetron. As shown in phantom in FIG. 1, the modulation signal can be directed from the main trigger generator to an electromagnet power supply for the magnetron magnet.

What is claimed is:

1. A particle accelerator system comprising:
an accelerator guide means for accelerating particles,
particle injection means for injecting particles into said guide means,
a source of radio frequency energy,
means for frequency modulating said radio frequency energy source,
means for introducing radio frequency energy from said source into said guide means for energy exchange with and acceleration of said particles,
motor means connected to said source for changing the output frequency of said source,
means connected to said motor means for producing a drive signal to drive said motor means and change said source frequency,
means for sensing the output amplitude of accelerated particles from said accelerator guide means including means measuring current pulses of the accelerated particles from said accelerator guide means, and
means connected to said sensing means and to said drive signal producing means to activate said drive signal producing means and drive said motor means until the sensed output amplitude is maximum, said activating means including means for synchronously demodulating a signal received from said sensing means.

2. The system of claim 1 wherein said sensing means includes an ionization chamber, a particle collection plate in the chamber and means for sampling particle current at said plate to obtain an output signal representative of the modulated particle pulses.

3. The system of claim 2 including
means for driving said motor means across the range of frequency change of said source
means responsive to said sensing means to initiate said driving means when the particle output amplitude falls below a preset level.

4. The system of claim 3 including a particle integrator means connected to said sensing means for delivering particle pulses upon integration of a particle charge of a predetermined value.

5. The system of claim 4 including means for turning off the particle injection means either upon failure of particle integration pulses or continued operation of said initiation means after drive of said motor means across said frequency range.

6. The system of claim 1 wherein:
said source means includes a magnet structure and
said frequency changing means includes means for modulating said magnet.

7. In a particle accelerator system having an accelerator guide, a particle injector, means for introducing into the guide radio frequency energy from a tunable radio frequency source, the improvement for maintaining the source at the desired frequency for driving the accelerator comprising:
means for tuning the source across a range of frequency change of the source,
means for modulating the particle pulses of the accelerator,
means for sensing the particle output amplitude from the accelerator and generating a signal representative of the modulated particle pulses,
means for synchronously demodulating the representative signal to produce a frequency error voltage,
means responsive to said error voltage for changing the frequency of the source whereby said source is tuned for maximum particle output amplitude, and
means responsive to said sensing means to initiate said tuning means when the particle output amplitude falls below a preset level.

8. In the particle accelerator system of claim 7:
the source comprising a magnetron with a mechanical tuner for changing the frequency thereof,
said modulating means including means for modulating said tuner, and
said frequency changing means including means for driving said tuner.

9. In the particle accelerator system of claim 7:
the source means comprising a magnetron with an electromagnet and
said modulating means including means for modulating said electromagnet.

10. In the particle accelerator system of claim 7 particle integrator means connected to said sensing means for delivering particle pulses upon integration of a particle charge of a predetermined value.

11. In the particle accelerator system of claim 10 means for turning off the particle injector either upon failure of particle integration pulses or continued operation of said initiation means after drive of said tuning means across said frequency range.

12. In a particle accelerator system having an accelerator guide, a particle injector, means for introducing into the guide radio frequency energy from a tunable radio source, the improvement comprising:
means for modulating the particle pulses in the accelerator,
means for sensing the particle output amplitude from the accelerator and generating a signal representative of the modulated particle pulses,
means for tuning the source across a range of frequency changes of the source,
potentiometer means for following the operating frequency setting of the source, means for synchronously demodulating the representative signal to produce a frequency error voltage, means responsive to said error voltage for driving said tuning means until the source is operating at the desired frequency, potentiometer means for setting the desired operating frequency of the source and following the operating frequency setting of the source, switch means for connecting one of said sensing means and the potentiometer means to said tuning means for changing the source frequency to the desired frequency setting or the frequency for maximum particle output amplitude, means responsive to said sensing means to initiate said tuning means when the switch means connects said sensing means to said changing means and the particle output amplitude falls below a preset level, particle integrator means connected to said sensing means for delivering particle pulses upon integration of a particle change of a predetermined value, and means for turning off the particle injector upon failure of particle integration pulses or continued operation of said initiation means after drive of said tuning means across said frequency range.

* * * * *